United States Patent [19]

Koump

[11] 4,026,698

[45] May 31, 1977

[54] REMOVAL OF TIN FROM MOLTEN IRON BY CHLORINATION, USING OXYGEN TO CONSERVE CHLORINE AND TO PRODUCE TIN OXIDE

[75] Inventor: Valentin Koump, Greensburg, Pa.

[73] Assignee: Urban Reclamation Technologies, Inc., Greensburg, Pa.

[22] Filed: Sept. 18, 1975

[21] Appl. No.: 614,498

[52] U.S. Cl. ..... 75/59; 75/63; 75/64

[51] Int. Cl.[2] ..... C21C 5/30

[58] Field of Search ..... 75/59, 63, 64

[56] References Cited

UNITED STATES PATENTS

| | | | |
|---|---|---|---|
| 2,899,295 | 8/1959 | Kattner | 75/64 |
| 3,484,232 | 12/1969 | Karinthi | 75/59 |
| 3,615,357 | 10/1971 | Wainer | 75/64 |
| 3,640,702 | 2/1972 | Karinthi | 75/59 |

*Primary Examiner*—P. D. Rosenberg
*Attorney, Agent, or Firm*—Morse, Altman, Oates & Bello

[57] ABSTRACT

A process for detinning molten iron involves bubbling gaseous chlorine through the molten iron bath, which contains dissolved tin among other elements (e.g. manganese). As chlorides of tin, iron and these other elements are leaving the metal bath in vapor form, and subsequently after condensation, these chlorides are oxidized by injection of oxygen into the space above the molten bath and into the gas duct and heat exchanger, thereby converting the chlorides into their respective oxides and liberating the chlorine as a gas for recycling. Because of this chlorine recycling, net chlorine requirements of the present process are very much less than the net chlorine requirements in a detinning process that involves simply chlorine treatment of molten iron.

11 Claims, 5 Drawing Figures

REMOVAL OF TIN FROM MOLTEN IRON BY CHLORINATION, USING OXYGEN TO CONSERVE CHLORINE AND TO PRODUCE TIN OXIDE

BACKGROUND OF THE INVENTION

The present invention relates to the removal of impurities from iron and, more particularly, to the removal of tin from molten iron by chlorination.

It is well known that removal of tin by direct oxidation from iron/tin solution is impossible since, at steelmaking temperatures, iron oxide is more stable than tin oxide. The standard free energy of formation of iron oxide at 1800° K is about −35K cal/gm mole whereas the standard free energy of formation of tin oxide is −27K cal/gm mole. In other words, iron oxide forms prior to tin oxide in an oxidation process so that removal of tin by oxidation has not been achieved practically.

The primary object of the present invention is to provide a process for converting tin, which is dissolved in molten iron, into tin oxide by converting the tin to gaseous tin chloride, reacting either the gaseous tin chloride or tin chloride in condensed form with oxygen to form tin oxide and free chlorine, separating the tin oxide from the gas by filtering and recycling the gaseous chlorine into the iron bath. Some other metals dissolved in iron and some iron generally will be evaporated during the chlorination process together with the tin. Since the cost of oxygen is substantially lower than the cost of chlorine, the total operating cost of the present process is substantially lower than that of direct chlorination. Approximately 70 to 95% of the chlorine gas used in chlorination of molten iron bath becomes available for recycling in the present process.

Other objects of the present invention will in part be obvious and will in part appear hereinafter.

The invention accordingly comprises the process, and its steps, which are described in the present disclosure and defined in the appended claims.

BRIEF DESCRIPTION OF THE DRAWINGS

For a fuller understanding of the nature and objects of the present invention, reference is made to the following detailed description, which is to be taken in connection with the accompanying drawings, wherein.

DETAILED DESCRIPTION OF THE PREFERRED EMBODIMENTS

Figure 1:
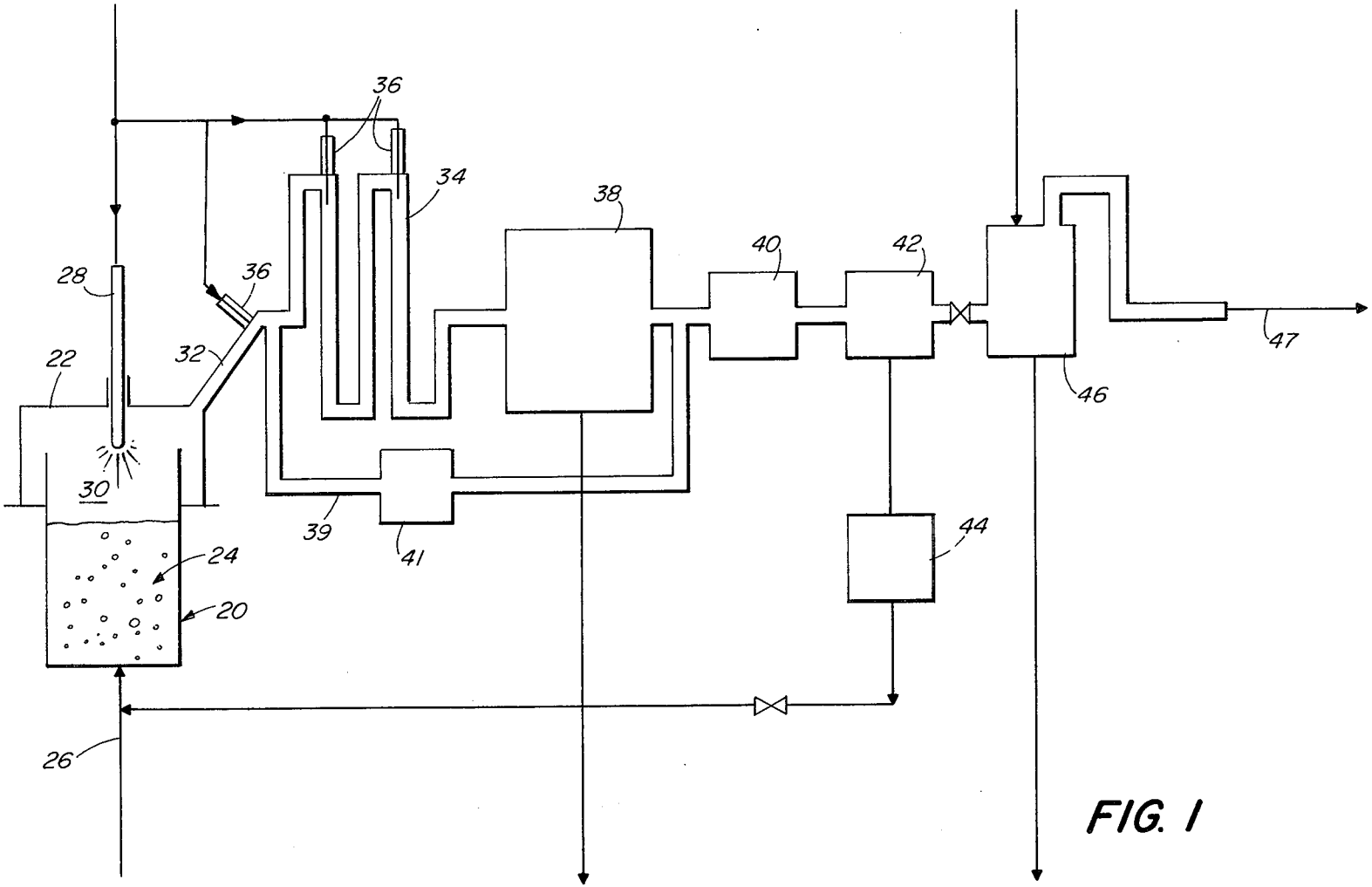
FIG. 1 is a schematic drawing, illustrating the flow of a process in accordance with the present invention.

In the system of the present invention, as illustrated in FIG. 1, steel scrap containing high concentration of tin, i.e. for example ferrous fraction from municipal solid wastes, is melted by conventional means and molten raw iron is transferred to ladle 20, which has a ladle cover 22 and entrance and exit ports to be described more fully below. Within the ladle, the iron melt 24 at 1200° to 1700° C. contains impurities typical of those found in scrap, namely, carbon, silicon, manganese, aluminum, titanium, tin, lead, nickel, chromium, molybdenum, copper, vanadiam, arsenic, and tungsten. Pursuant to the present process, chlorine gas is bubbled from a supply 26 through the iron melt. While passing through the iron bath, the chlorine reacts with dissolved manganese, aluminum, tin, titanium, lead and iron, thereby forming manganese chloride, aluminum chloride, tin chloride, titanium chloride, lead chloride and iron chloride. These chlorides leave the molten iron bath as vapors. Oxygen and/or air is blown through a lance 28 into the region 30 above the molten iron bath and lances 36 into duct 32 and heat exchanger 34 and reacts with the metal chlorides in accordance with the following equations:

$$Fe\,CL_2 + \tfrac{1}{2}\,O_2 \rightarrow FeO + Cl_2$$

$$Mn\,Cl_2 + \tfrac{1}{2}\,O_2 \rightarrow MnO + Cl_2$$

$$Al\,Cl_3 + 3/2\,O_2 \rightarrow \tfrac{1}{2}\,Al_2O_3 + 3/2\,Cl_2$$

$$Ti\,Cl_3 + \tfrac{1}{2}\,O_2 \rightarrow TiO + 3/2\,Cl_2$$

$$Sn\,Cl_2 + O_2 \rightarrow SnO_2 + Cl_2$$

$$Pb\,Cl_2 + \tfrac{1}{2}\,O_2 \rightarrow PbO + Cl_2$$

Other chlorides form and leave the melt in smaller concentrations.

The first two reactions (the only reactions that liberate significant amount of energy during oxidation of metal chlorides) are moderately exothermic so that the temperature of gases in ladle cover, gas duct and heat exchanger are affected by injected oxygen or air. As indicated above, the oxygen reacts, at a temperature ranging from 100° to 1700° C and preferably from 900° to 1300° C, with the metal chlorides either in the vapor phase in region 30; or at lower temperatures in condensed form in duct 32 of heat exchanger 34. Thus metal oxides are formed and free chlorine gas is liberated.

The reaction products, including chlorine gas, $N_2$,$O_2$ and $CO_2$, partially reacted metal chloride particles and metal oxide particles, move from the ladle cover through a gas duct 32 and are mixed with cold recycle gas circulated through conduit 39 by pump 41, to control the temperature of gases and condensed particles entering heat exchanger 34. Gas duct 32 and heat exchanger 34 have additional lances 36 through which oxygen or air is blown to achieve further oxidation of metal chlorides and conversion of lower metal oxides to higher oxides. By controlling the amount and distribution of oxygen in region 30, duct 32 and heat exchanger 34, the temperature of gases and the degree of recovery of chlorine gas at the exit from the heat exchanger is controlled.

The oxide particles are filtered from the gas in a filter 38 and removed from the filter as a mixture of oxides containing high percentages of iron and manganese oxides; and smaller percentages of oxides of tin, lead, aluminum and titanium. A portion of the gas leaving filter 38 is recycled to duct 32 and the remainder is piped first to a compressor 40 where its pressure is increased to the range of from 150 to 350 pounds per square inch and then to a condenser-separator 42 which operates at a temperature ranging from 0° to 70° C at which chlorine is condensed and separated from the other waste gases. From condenser-separator 42, the chlorine is piped to an evaporator 44, which operates at a temperature ranging from 30° to 120° C and pressure ranging from 50 to 100 pounds per square inch to vaporize the chlorine. The resulting chorine gas is throttled to a lower pressure which depends on the method of injection of chlorine gas and recycled to ladle 20. The waste gases are piped from condenser-separator 42 to a waste gas wash tower 46 where they are washed with aqueous solution of NaOH or $Ca(OH)_2$ to remove residual chlorine and traces of metal chlorides. In another version of the process a portion of waste gases 47 (or an inert gas such as argon, helium or nitrogen) is recycled, mixed with chlorine gas and injected into the molten iron bath through a lance, porous plug or tuyeres. Dilution of chlorine gas by waste gas prior to injection into the molten iron bath (a) reduces heat generation in the injection regions and increases the life of the lance, porous ladle bottom or tuyeres, (b) increases efficiency of utilization of chlorine gas, by reducing pounds of iron vaporized per pound of tin removed.

In still another version of the process, iron oxide powder is injected into the molten iron bath during chlorination treatment (a) to increase local concentration of oxygen in molten iron in the reaction zone and thereby to reduce the rate of formation of iron chloride, (b) to counteract the exothermic effects of the chlorination reactions. Iron oxide is injected either together with chlorine gas, or separately, through a concentric lance, concentric tuyeres or through one or more tuyeres placed in immediate proximity to tuyeres used for injection of chlorine gas. The waste gas 47, or air, may be used as a carrier gas for injection of iron oxide.

Figure 2:
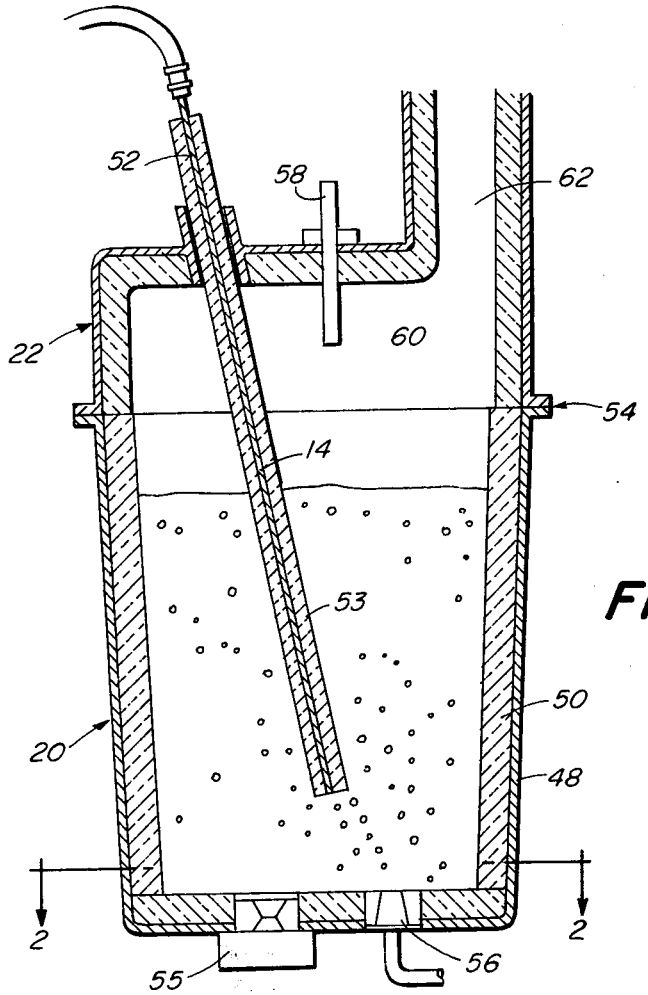
FIG. 2 is a medial cross-sectional view of a component of one embodiment of the system of FIG. 1.
Figure 3:
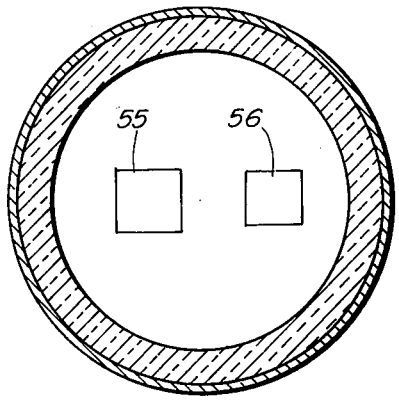
FIG. 3 is a bottom plan view of the component of FIG. 2.

FIG. 2 illustrates one embodiment of molten iron chlorination vessel as including ladle 20 and ladle cover 22. Both the ladle and the ladle cover include an external steel shell 48 and an internal refractory lining 50, composed for example of high alumina brick. Bubbling of the chlorine into the molten bath in the ladle occurs through a lance 52 in the form of a ceramic or graphite tube 14 in a refractory sleeve 53 or a nickel or nickel clad steel tube in a refractory sleeve, or a tube, composed of other alloys resistant to chlorine gas at high temperatures in a refractory sleeve. The refractory sleeve is composed of similar refractory to that of the vessel lining. A gas seal 54 prevents escape of the metal chloride and oxides to the surroundings and uncontrolled entry of air into enclosure 60. At the bottom of ladle 20 are a slide gate valve 55 and a small porous plug 56. Slide gate valve 55 permits removal of molten steel from the ladle after completion of the steelmaking cycle. Porous plug 56 serves to enable the bubbling of small amounts of an inert gas, such as argon or nitrogen for mixing purposes during treatment following the detinning operation. Extending through ladle cover 22 is a water cooled lance 58, for the introduction of the oxygen and/or air. The mixture of gasses and oxide particles formed in region 60, in accordance with the present process, leave through a duct 62 in ladle cover 22.

Figure 4:
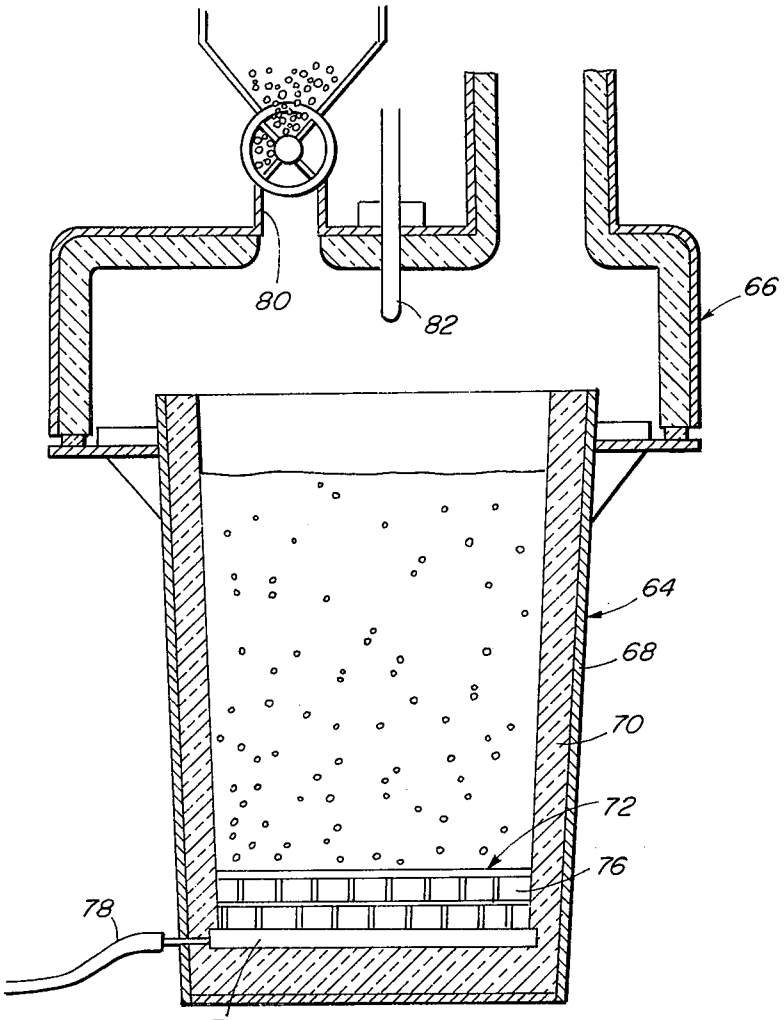
FIG. 4 is a medial cross-sectional view of an alternative component of the embodiment of the system of FIG. 1.

FIG. 4 illustrates another embodiment of the molten iron chlorination vessel as including a ladle 64 and a ladle cover 66. Both the ladle and the ladle cover include an external steel shell 68 and an internal refractory lining 70, composed of similar refractories as in the vessel in FIG. 2. Bubbling of chlorine into the molten bath in the ladle occurs through a porous bottom 72. Porous bottom 72 includes a distribution chamber 74 constructed from nickel plate or other alloys resistant to chlorine gas at moderate temperatures and several layers of bricks 76 composed of a refractory material such as alumina and laid with porous alumina cement. In this embodiment, chlorine is introduced into the melt from a supply 78 through distribution chamber 74 and tiers of bricks 76. Mounted on ladle cover 66 are a hopper 80 with a rotary feeder, for loading coolants (iron ore, shredded scrap) and an oxygen and/or air lance 82.

The reactions of iron, manganese and tin with gaseous chlorine are exothermic so that heat generation accompanies bubbling of chlorine through the molten bath. A resulting temperature rise of from 20° to 120° C normally would occur depending on ladle size and on the rate and duration of chlorine bubbling. In order to maintain the melt at essentially constant temperature throughout the chlorination treatment, iron containing solids, e.g. shredded steel scrap, iron oxide pellets or iron ore, are introduced through hopper 80. If steel scrap is used as a coolant, the amount of steel scrap required for a 30 ton ladle ordinarily varies from 0.6 to 1.4 tons.

Figure 5:
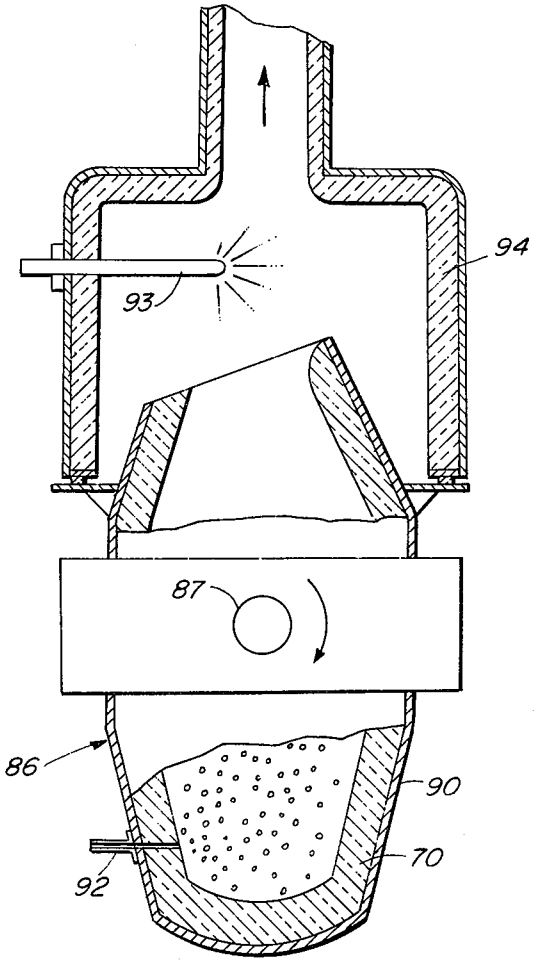
FIG. 5 is a medial cross-sectional view of another alternative component of the embodiment of the system of FIG. 1.

FIG. 5 illustrates still another embodiment of the steel making vessel as including a vessel 86 capable of tilting about the axis 87. Vessel 86 includes an external steel shell 90 and an internal refractory lining 70, composed for example of high alumina brick. Bubbling of chlorine into the melt occurs through a series of tuyeres 92 near the bottom of the ladle, and introduction of oxygen occurs through the lance 93 in the side of the cover 94. In this embodiment, the detinning vessel is filled with molten iron while the vessel is in a horizontal position with the tuyeres above the level of the melt. Thereafter, after the flow of gas through the tuyeres has begun, the vessel is uprighted and the chlorination and oxydizing process begins.

The following non-limiting examples further illustrate the present invention.

EXAMPLE I

In a specific example of the process of FIG. 1, the vessel typically contains 20 to 200 tons of molten iron. In the following description for simplicity, all data are in terms of pounds and hours based upon one ton total weight of iron melt. This example involves relatively slow bubbling of chlorine under the following conditions and with the following results.

| Basis | Approximately |
|---|---|
| Molten iron | 1 ton |
| Chlorine rate (into the ladle) | 80 lb/hr |
| Time of treatment | 1.13 hr |
| Initial % Sn | 0.43 |
| Final % Sn | 0.06 |
| Oxygen consumed | 27.7 lb |
| Chlorine consumed | 9.1 |
| Metal Oxides Produced | |
| Mn oxide | 12.3 lb |
| Al oxide | 0.6 lb |
| Ti oxide | 7.8 lb |
| Sn oxide | 8.6 lb |
| Fe oxide | 70.7 lb |

$$\frac{Cl_2 \text{ consumed}}{\text{Sn removed}} = 1.3$$

$$\frac{\text{Fe evaporated}}{\text{Sn removed}} = 7.3$$

Fe loss = 2.73%

-continued $$\frac{O_2 \text{ consumed}}{\text{Sn removed}} = 4.4$$

EXAMPLE II

In another specific example of the process of FIG. 1, the vessel typically contains 20 to 200 tons of molten iron. In the following description, for simplicity, all data are in terms of pounds and hours based upon one ton total weight of iron melt. This example involves relatively fast bubbling of chlorine for a short period under the following conditions and with the following results.

| Basis | Approximately |
|---|---|
| Molten iron | 1 ton |
| Chlorine rate (into the ladle) | 290 lb/hr |
| Time of treatment | 0.25 hr |
| Initial % Sn | 0.2 |
| Final % Sn | 0.05 |
| Oxygen consumed | 24.7 lb |
| Chlorine consumed | 7.3 lb |
| Metal Oxides Produced | |
| Mn oxide | 18.1 lb |
| Al oxide | — |
| Ti oxide | — |
| Sn oxide | 3.8 lb |
| Fe oxide | 61.5 lb |
| $\frac{Cl_2 \text{ consumed}}{\text{Sn removed}} = 2.4$ | |
| $\frac{\text{Fe evaporated}}{\text{Sn removed}} = 14.3$ | |
| Fe loss = 2.3% | |
| $\frac{O_2 \text{ consumed}}{\text{Sn removed}} = 8.2$ | |

EXAMPLE III

In still another specific example of the process of FIG. 1, the vessel typically contains 20 to 200 tons of molten iron. In the following description, for simplicity, all data are in terms of pounds and hours based upon one ton total weight of iron melt. This example involves relatively fast bubbling of chlorine for a longer period under the following conditions and with the following results.

| Basis | Approximately |
|---|---|
| Molten iron | 1 ton |
| Chlorine rate (into the ladle) | 290 lb/hr |
| Time of treatment | 0.417 hr |
| Initial % Sn | 0.2 |
| Final % Sn | less than 0.005 |
| Oxygen consumed | 41.2 lb |
| Chlorine consumed | 12.1 lb |
| Metal Oxides Produced | |
| Mn oxide | 18.1 lb |
| Al oxide | — |
| Ti oxide | — |
| Sn oxide | 5.1 lb |
| Fe oxide | 115.5 lb |
| $\frac{Cl_2 \text{ consumed}}{\text{Sn removed}} = 3.03$ | |
| $\frac{\text{Fe evaporated}}{\text{Sn removed}} = 20.2$ | |
| Fe loss = 4.4% | |

-continued $$\frac{O_2 \text{ consumed}}{\text{Sn removed}} = 10.3$$

ADVANTAGES

It will be seen that the above process is substantially superior to a "once through"detinning process in which chlorine gas is bubbled through the molten iron, and metal chlorides are condensed and separated from the waste gas.

The advantages of the process of this invention over the once through process are:

1. Substantially lower consumption of chlorine gas per pound of tin removed, i.e. approximately 1/10 of chlorine gas usage in one example of a once through process.

2. The metals (iron, manganese, tin etc.) evaporated from the molten bath during detinning are converted into stable, water insoluble compounds (metal oxides) that can be stored outside.

Since certain changes may be made in the present disclosure without departing from the invention thereof, it is intended that all matter described in the above specification or shown in the accompanying drawings be interpreted in an illustrative and not in a limiting sense.

What is claimed is:

1. A process for detinning an iron melt containing minor concentrations of elements other than iron including tin, said process comprising the steps of bubbling chlorine through said melt in order to produce a flow of gas from said melt and through a reaction region outside of said melt, said gas including vapors of metal chlorides, reacting oxygen with said metal chlorides as it flows from said melt in said reaction region to produce metal oxides and chlorine gas, removing said metal oxides from said reaction region, and recycling said last-mentioned chlorine into said melt, said melt being carried by a reaction vessel and said reaction regions is above said melt in said reaction vessel, said reacting with oxygen occuring at a temperature at least as great as 1550° C.

2. The process of claim 1 wherein said melt is carried by a reaction vessel and said reaction regions is above said melt in said reaction vessel.

3. The process of claim 2 wherein said reacting with oxygen occurs at a temperature at least as great as 1550° C.

4. The process of claim 1 wherein said metal chloride vapors flowing from said melt are condensed in a heat exchanger.

5. The process of claim 4 wherein said reacting of metal chlorides with oxygen occurs in said heat exchanger at a temperature ranging from 300° to 1600° C.

6. The process of claim 1 wherein said melt is carried by a reaction vessel and said reaction region is above said melt and in a heat exchanger, said reacting of metal chlorides with oxygen occuring above said melt and in said heat exchanger.

7. The process of claim 1 wherein said iron melt ranges in temperature from 1200° to 1700° C.

8. The process of claim 1 wherein said chlorine bubbled through said melt is diluted with a gas selected from the class consisting of $N_2$, $O_2$, $CO_2$ and noble gases.

9. The process of claim 1 wherein iron oxide is suspended in said chlorine gas.

10. The process of claim 1 wherein iron oxide is introduced into said melt at the point of injection of chlorine gas into the melt during said bubbling into said melt of said chlorine.

11. The process of claim 1 wherein said metal chloride vapors flowing from said melt are condensed and cooled to desired optimum reaction temperature by mixing these gases with cold gases recycled from gas stream following the filter.

* * * * *